US005238300A

United States Patent [19]

Slivon et al.

[11] Patent Number: 5,238,300

[45] Date of Patent: Aug. 24, 1993

[54] RETRACTABLE STEP AND TOOL CABINET INCORPORATING SAME

[75] Inventors: George R. Slivon; Gene E. Olson; Steven R. Wente, all of Kenosha, Wis.

[73] Assignee: Snap-on Tools Corporation, Kenosha, Wis.

[21] Appl. No.: 788,941

[22] Filed: Nov. 7, 1991

[51] Int. Cl.[5] ..... F47B 83/00

[52] U.S. Cl. ..... 312/235.1; 108/91

[58] Field of Search ..... 312/235.1, 235.3; 182/91

[56] References Cited

U.S. PATENT DOCUMENTS

| | | | |
|---|---|---|---|
| 283,512 | 8/1883 | Reynolds | 312/235.1 |
| D. 292,937 | 11/1987 | Richey . | |
| 2,495,374 | 1/1950 | Horn . | |
| 3,083,053 | 3/1963 | Dorsey . | |
| 3,481,429 | 12/1969 | Gaede . | |
| 3,756,678 | 9/1973 | Kloppenstein . | |
| 3,888,510 | 6/1975 | Maske . | |
| 3,959,991 | 6/1976 | Brown | 312/235 A |
| 4,135,604 | 1/1979 | Ryan . | |
| 4,312,515 | 1/1982 | Allori . | |
| 4,545,628 | 10/1985 | Richey . | |
| 4,570,962 | 2/1986 | Chavira . | |
| 4,924,970 | 5/1990 | Seals et al. . | |

FOREIGN PATENT DOCUMENTS

| | | |
|---|---|---|
| 0210465 | 2/1987 | European Pat. Off. . |
| 2055705 | 3/1981 | United Kingdom . |

*Primary Examiner*—Kenneth J. Dorner
*Assistant Examiner*—Gerald A. Anderson
*Attorney, Agent, or Firm*—Emrich & Dithmar

[57] ABSTRACT

A tool cabinet has rollers depending from a bottom wall for rolling engagement with an underlying floor. A retractable step is carried by a support arm which extends laterally from the step and has an upstanding shaft portion which extends through an axial bore in a spiral cam which is fixed to the bottom wall of the cabinet. The shaft has a cam follower pin which extends therefrom and is slidably engageable with a spiral cam surface on the cam for accommodating simultaneous pivotal swinging movement and vertical movement of the step between a stowed position disposed beneath the cabinet and above the floor and a use position extending from beneath the cabinet in engagement with the floor.

15 Claims, 2 Drawing Sheets

RETRACTABLE STEP AND TOOL CABINET INCORPORATING SAME

BACKGROUND OF THE INVENTION

1. Field of the Invention

The present invention relates to tool chests or cabinets of the type commonly used by mechanics in auto repair shops and, in particular, to relatively tall cabinets having a retractable step to facilitate access to the upper portions of the cabinet.

2. Description of the Prior Art

Tool chests or cabinets for the use of mechanics or the like are well known and are commonly used in auto repair facilities. Such tool cabinets are typically supported on wheels or rollers to facilitate movement about the floor of the work space. It is not uncommon for such tool cabinets to be quite large and, in particular, they may be five or six feet in height. In such tall cabinets it may be difficult for the mechanic to see into the upper drawers of the cabinet to determine the contents thereof.

Accordingly, it is known to provide a retractable step for such tool cabinets. One such step is disclosed in U.S. Pat. No. 4,545,628. That step is supported on a horizontal slide type mechanism which is hung from the bottom wall of the cabinet. The step is horizontally slidably movable, forwardly and rearwardly of the cabinet, between a retracted position stowed underneath the cabinet and an extended use position which is disposed in front of the cabinet. The step support is provided with spring-biased mechanism which maintains the step spaced above the floor until it is stepped on by the operator, whereupon it lowers into engagement with the floor against the urging of the bias springs. While this arrangement works satisfactorily, the support for the retractable step is a multi-part arrangement which is quite complex and relatively expensive.

SUMMARY OF THE INVENTION

It is a general object of the invention to provide an improved retractable step and a cabinet incorporating same which avoid the disadvantages of prior cabinets and steps while affording additional structural and operating advantages.

An important feature of the invention is the provision of a retractable step assembly which is of relatively simple and economical construction and which accommodates easy movement between retracted and use positions.

In connection with the foregoing feature, it is another feature of the invention to provide a retractable step assembly of the type set forth which accommodates pivotal swinging movement between the retracted and use positions thereof.

Another feature of the invention is the provision of a retractable step assembly of the type set forth, which accommodates simultaneous pivotal and lowering movement between the retracted and use positions.

Yet another feature of the invention is the provision of a retractable step assembly of the type set forth, which is readily adaptable to retrofitting on existing cabinets.

A still further feature of the invention is the provision of a cabinet which incorporates a retractable step assembly of the type set forth.

These and other features of the invention are attained by providing a retractable step assembly including: a step having a tread surface, support means extending laterally from the step, attachment means carried by the support means above the step and laterally outwardly beyond the perimeter thereof and adapted to be connected to an associated overlying support surface, the support means including pivot means accommodating pivotal swinging movement of the step about an axis which is substantially perpendicular to the plane of the tread surface but does not intersect the step.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
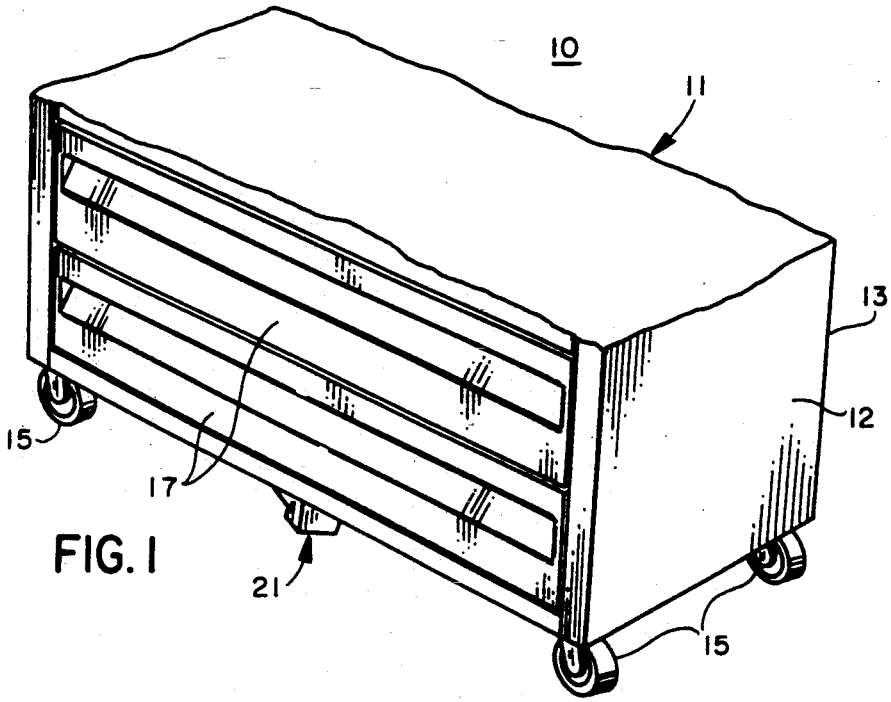
FIG. 1 is a fragmentary perspective view of a tool cabinet incorporating the retractable step assembly of the present invention., with the step assembly disposed in its stowed or retracted position.

Referring to FIGS. 1–4, there is illustrated a tool cabinet, generally designated by the numeral 10, of the type used by automotive mechanics and the like, and incorporating a retractable step assembly 20, constructed in accordance with and embodying the features of a first embodiment of the present invention. The tool cabinet 10 includes a housing 11 having a pair of parallel, upstanding side walls 12 interconnected at their rear ends by a rear wall 13 and at their lower edges by a bottom wall 14. The housing 11 is supported on four rollers 15, respectively disposed adjacent to the corners of the bottom wall 14 for supporting the housing 11 a predetermined distance above an underlying floor 16. The front of the housing 11 is open and is provided with a plurality of drawers 17, in standard fashion, for containing mechanics' tools.

The retractable step assembly 20 includes a step 21 having a platform 22 which is illustrated as being hexagonal in shape, but may have any desired shape. The platform 22 is provided with an upper tread surface 23 which may be formed of a suitable frictional non-slip material, such as rubber or the like. Preferably, the platform 22 has secured to its underside a stiffening channel 24 (see FIG. 7) to provide rigidity to the platform 22 and for attachment purposes, as will be explained more fully below. Integral with the platform 22 around its perimeter and depending therefrom is a peripheral side wall 25 provided at its lower edge with a plurality of recesses 26 which cooperate to define support legs 27, respectively disposed adjacent to the corners of the platform 22. Preferably, a notch 28 is formed in the bottom edge of the peripheral side wall 25, (see FIG. 7).

Figure 5:
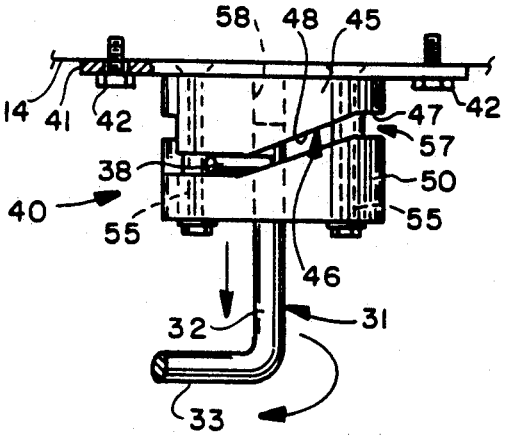
FIG. 5 is a fragmentary elevational view of the pivot mechanism of the atep assembly of FIG. 4, illustrated in its lowered use position.
Figure 7:
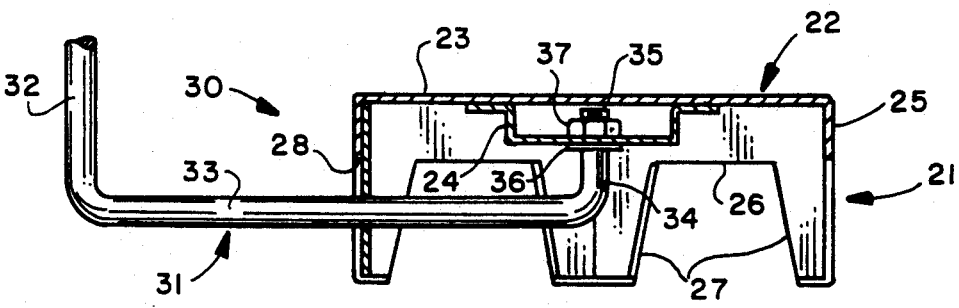
FIG. 7 is an enlarged fragmentary view in vertical section of the step assembly of FIG. 4, illustrating the manner of attachment of the support mechanism to the step.

Referring also to FIG. 7, the retractable step assembly 20 is provided with a support assembly 30, which includes a generally J-shaped support arm 31. The support arm 31 includes an upstanding vertical shaft portion 32 provided at its lower end with a horizontal portion 33 which is, in turn, provided at its distal end with an upstanding attachment portion 34. The attachment portion 34 is provided at its distal end with a threaded stud 35 which extends in use through a complementary opening in the stiffening channel 24 and is provided with a suitable washer 36 and nut 37 for fixedly securing the support arm 31 to the step 21 substantially centrally of the platform 22. It will be appreciated that the horizontal portion 33 is accommodated in the notch 28 when the support arm 31 is attached to the step 21, as described above. Integral with the vertical shaft portion 32 of the support arm 31 adjacent to its upper end is a laterally outwardly extending cam follower arm 38 (FIG. 5).

Figure 4:
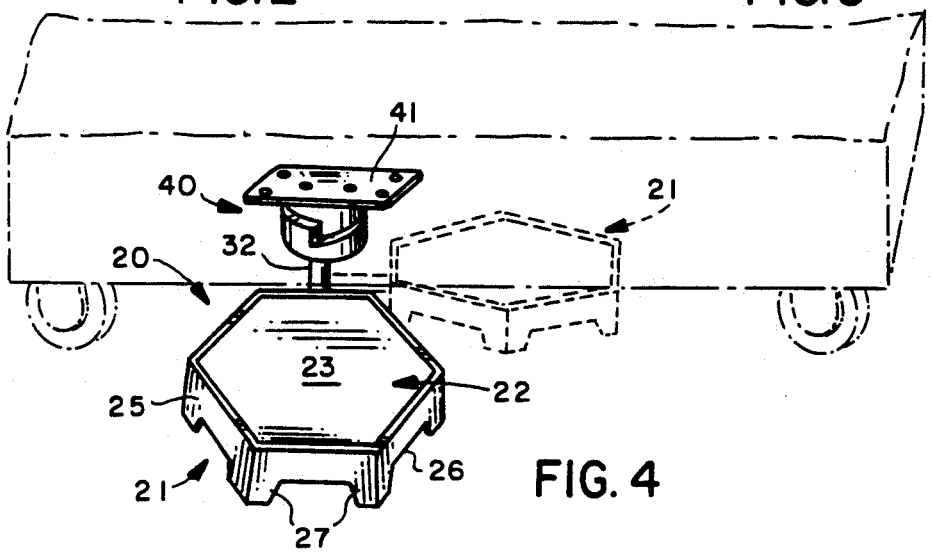
FIG. 4 is a perspective view of the step assembly of the present invention illustrated in its us position in solid line and in its retracted position in broken line, and with the associated tool cabinet fragmentarily illustrated in phantom.
Figure 6:
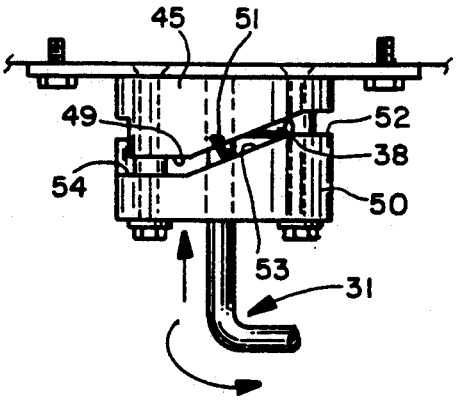
FIG. 6 is a view similar to FIG. 5, illustrating the mechanism in its raised, retracted position.

The support assembly 30 also includes a spiral cam pivot assembly 40. Referring in particular to FIGS. 4–6, the pivot assembly 40 includes a flat mounting plate 41 which is fixedly secured to the underside of the bottom wall 14 of the tool cabinet 10 by suitable fasteners 42. Fixedly secured to the mounting plate 41 is a generally cylindrical upper body 45 of a spiral cam, which has formed on its bottom side a spiral cam surface 46, which includes an upper horizontal shelf portion 47, a downwardly inclined portion 48 and a lower horizontal shelf portion 49. The pivot assembly 40 also includes a lower cam body 50 which is generally cylindrical in shape and is provided at its upper end with a cam surface 51, which is dimensioned substantially to be uniformly spaced from the cam surface 46. More specifically, the cam surface 51 includes an upper horizontal shelf portion 52, a downwardly inclined portion 53 and a lower horizontal shelf portion 54. The upper and lower bodies 45 and 50 are interconnected by a plurality of fasteners 55, which serve to suspend the lower body 50 from the upper body 45 a predetermined distance therebelow, so that the upper and lower cam surfaces 46 and 51 cooperate to define therebetween a spiral cam slot 57.

Also formed through the upper and lower cam bodies 45 and 50 are axial bores 58, which are aligned coaxially in use for cooperation to rotatably receive therethrough the vertical shaft portion 32 of the support arm 31 with the cam follower arm 38 projecting laterally into the spiral cam slot 57 for sliding engagement with the upper and lower cam surfaces 46 and 51. More specifically, it will be appreciated that, in assembly, the vertical shaft portion 32 is inserted through the axial bores 58 prior to interconnection of the upper and lower cam bodies 45 and 50 by the fasteners 55.

Figure 2:
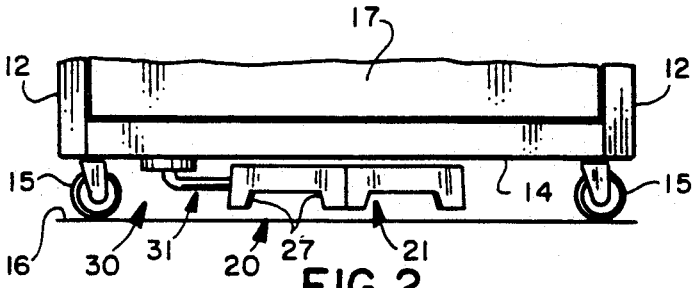
FIG. 2 is a reduced, fragmentary, front elevational view of the tool cabinet of FIG. 1.
Figure 3:
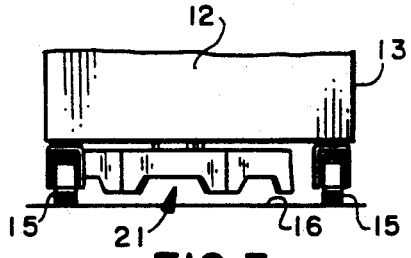
FIG. 3 is a fragmentary end elevational view of the tool cabinet of FIG. 2.

The parts are so dimensioned and configured that, when the step assembly 20 is mounted on the cabinet 10, and the support assembly 30 is disposed in the position illustrated in FIG. 6, with the cam follower arm 38 disposed in the upper shelf portion of the spiral cam slot 57, the step 21 is disposed in a retracted position entirely underneath the tool cabinet 10 and spaced a predetermined distance above the floor 16, as can best be seen in FIGS. 2 and 3. In this regard, it will be appreciated that either or both of the upper and lower cam bodies 45 and 50 may be provided with a stop surface at the end of the upper shelf portions 47 and 52 to limit the movement of the retractable step assembly 20 toward its retracted position. Similarly, a suitable stop means (not shown) may be provided beneath the tool cabinet 10 for engagement with the step 21 in its retracted position to limit pivotal movement thereof. If desired, this stop means may be magnetic for magnetically attracting the step 21 and holding it in its retracted position. It will be appreciated that for this purpose, the step 21 may be formed of a suitable magnetizable metal.

When it is desired to move the retractable step assembly 20 to its use position, the underside of the step 21 is engaged as by the operator's foot and pulled forwardly, thereby pivoting the support assembly 30 in a clockwise direction about the axis of the vertical shaft portion 32 of the support arm 31, as illustrated in FIGS. 4 and 5. As the cam follower arm 38 reaches the inclined portion of the spiral cam slot 57, it slides under the force of gravity downwardly along the inclined portion 53 of the lower cam surface 51 and continues pivoting until it reaches the lower shelf portion 54, at which position the step 21 will have been pivotally swung outwardly from beneath the tool cabinet 10 to its use position illustrated in FIG. 4. If desired, stop means may also be provided on the spiral cam pivot assembly 40 for limiting the pivotal movement of the support assembly 30 toward the use position.

A significant aspect of the invention is that, by reason of the inclined nature of the spiral cam slot 57, the step 21 is lowered as it is pivoted so that, when it reaches the use position illustrated in FIG. 4, the legs 27 will be in engagement with the floor 16. For return of the retractable step assembly 20 to its retracted position, the operator simply uses his foot to swing the step 21 in a counterclockwise direction to its retracted position.

The simple attachment of the spiral cam pivot assembly 40 to the bottom wall 14 of the tool cabinet 10 permits the retractable step assembly 20 to be easily retrofitted to existing tool cabinets, as well as being mounted as original equipment on new tool cabinets.

Figure 8:
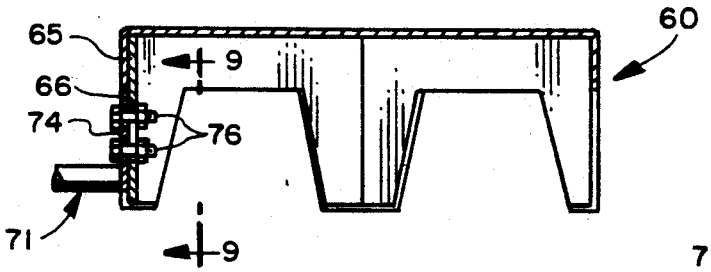
FIG. 8 is a view similar to FIG. 7, illustrating an alternative embodiment of mounting of the support structure to the step.
Figure 9:
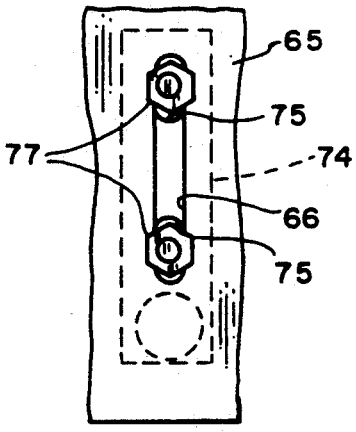
FIG. 9 is a further enlarged, fragmentary view taken along the line 9—9 in FIG. 8.

Referring now also to FIGS. 8 and 9, there is illustrated an alternative embodiment of the step assembly of the present invention, generally designated by the numeral 60. The step assembly 60 is substantially the same as the step assembly 20, except that it has a peripheral side wall 65 which is provided with an elongated vertical slot 66 therein. The support assembly 30 in this case includes a support arm 71, the attachment portion 74 of which is flattened and is provided with a pair of vertically spaced-apart apertures 75 therethrough for respectively receiving associated bolts 76 which pass through the slot 66 to be secured in place by suitable nuts 77, fixedly to secure the step 60 to the support arm 71. As can be readily appreciated, this arrangement permits easy adjustment of the height of the step 60 relative to the support arm 71. This will facilitate retrofitting of the retractable step assembly 20 to an existing tool cabinet, since such cabinets and, more particularly, the rollers 15 thereof may be of different sizes, resulting in different distances between the bottom wall 14 and the floor 16.

From the foregoing, it can be seen that there has been provided an improved tool cabinet and retractable step assembly therefor, which is of relatively simple and economical construction, and which provides for simultaneous swinging pivotal movement and raising and lowering movement of the step between the retracted and use positions.

We claim:

1. A tool cabinet comprising a housing including a plurality of drawers and a bottom wall, support structure depending from said bottom wall for supporting said housing a predetermined distance above a floor, a retractable step, and mounting means on said housing coupled to said step for supporting said step below said bottom wall, said mounting means including pivot means for accommodating pivotal swinging movement of said step between a stowed position disposed underneath said housing and a use position extending from underneath said housing and engageable with the floor, said pivot means including means operable in the stowed position of said step for preventing non-pivotal movement of said step into engagement with the floor.

2. The cabinet of claim 1, wherein said mounting means includes means for connection to said bottom wall.

3. The cabinet of claim 1, and further comprising stop means carried by said housing for engagement with said step for limiting the pivotal swinging movement of said step at said stowed position.

4. The cabinet of claim 1, wherein said pivot means includes means for accommodating vertical movement of said step simultaneously with the pivotal swinging movement of said step.

5. The cabinet of claim 4, wherein said pivot means includes cam mechanism defining a substantially spiral cam surface.

6. The cabinet of claim 1, wherein said step has a tread surface disposed in use substantially parallel to the floor, said mounting means including means for connection to said step substantially centrally of said tread surface.

7. The cabinet of claim 1, wherein said step includes a tread surface disposed in use substantially parallel to the floor, and a side wall depending from said tread surface at the periphery thereof, said mounting means including means for connection to said side wall.

8. The cabinet of claim 1, wherein said mounting means includes means for adjustable connection to said side wall at a variable height along said side wall.

9. The cabinet of claim 1, wherein said support structure includes a plurality of roller wheels.

10. A tool cabinet comprising a housing including a plurality of drawers and a bottom wall, support structure depending from said bottom wall for supporting said housing a predetermined distance above a floor, a retractable step, cam mechanism carried by said housing and defining a cam surface inclined with respect to the floor, cam follower means for engagement with said cam surface to move along said cam surface between raised and lowered positions, and connection means for connecting said step to said cam follower means for movement therewith between a retracted position above the floor when said cam follower means is disposed in the raised position of said cam follower means and a use position in engagement with the floor when said cam follower means is disposed in the lowered position of said cam follower means.

11. The cabinet of claim 10, wherein said cam mechanism includes means for accommodating swinging pivotal movement of said step between the retracted and use position of said step.

12. The cabinet of claim 10, wherein said cam mechanism includes means for defining a substantially spiral cam surface having an axis disposed in use substantially perpendicular to the floor.

13. The cabinet of claim 12, wherein said cam mechanism includes means for defining an axial bore through said cam mechanism, said connection means including a shaft extending through said axial bore, said cam follower means including a pin carried by said shaft and extending from said shaft for sliding engagement with said spiral cam surface.

14. The cabinet of claim 10, wherein said mounting means includes means for adjustable connection to said step at a variable height along said step.

15. The cabinet of claim 10, wherein said cam mechanism includes upper and lower cam surfaces cooperating to define a cam slot therebetween, said cam slot including upper and lower end portions disposed substantially parallel to the floor and an inclined portion interconnecting said upper and lower portions, said cam follower means being engageable with each of said upper and lower cam surfaces for guiding movement of said cam follower means.

* * * * *